US005894946A

United States Patent [19]

Darnell et al.

[11] Patent Number: 5,894,946

[45] Date of Patent: Apr. 20, 1999

[54] STORAGE RACK SYSTEM WITH TAPERED STORAGE RACK ARM AND STORAGE RACK ARM PROTECTIVE DEVICE

[75] Inventors: William Travis Darnell, Atlanta; William Alan Darnell, Big Canoe; Daniel William Reed, Mableton, all of Ga.

[73] Assignee: Sunbelt Material Handling, Inc., Alpharetta, Ga.

[21] Appl. No.: 08/853,072

[22] Filed: May 8, 1997

[51] Int. Cl.[6] ..... A47F 5/00

[52] U.S. Cl. ..... 211/193; 211/183; 248/345.1

[58] Field of Search ..... 211/193, 190, 211/183; 248/345.1

[56] References Cited

U.S. PATENT DOCUMENTS

| | | | |
|---|---|---|---|
| 1,557,445 | 10/1925 | Euller | 248/345.1 X |
| 3,164,255 | 1/1965 | Jay . | |
| 3,512,654 | 5/1970 | Olsen et al. | 211/193 |
| 3,533,514 | 10/1970 | Kellinger et al. . | |
| 3,604,670 | 9/1971 | Reeves | 248/345.1 X |
| 3,707,273 | 12/1972 | Bortz | 248/345.1 X |
| 4,117,938 | 10/1978 | Klein . | |
| 4,426,011 | 1/1984 | Jay | 211/193 |
| 5,273,170 | 12/1993 | Azzeopardi et al. | 211/193 X |

OTHER PUBLICATIONS

*Cantilever Storage Systems, Customized for Your Every Need*, Lodi Metal Tech, Inc.

*Primary Examiner*—Robert W. Gibson, Jr.
*Attorney, Agent, or Firm*—Jones & Askew, LLP

[57] ABSTRACT

A storage rack system with tapered storage rack arms and a protective device for covering the exposed outer ends of the storage rack arms. The tapered storage rack arms have tapered lower sides and may have upwardly inclined upper sides. The tapered lower sides allow material to be loaded onto subjacent storage rack arms without scraping or colliding with the lower sides or exposed outer ends of the tapered storage rack arms located above. The protective device utilizes an arcuately shaped member attached to a support member. The support member of the protective device is attached to the exposed outer end of the storage rack arm of the storage rack unit. The protective device prevents collision with the exposed outer ends of the storage rack arms by personnel, customers, equipment and material.

18 Claims, 5 Drawing Sheets

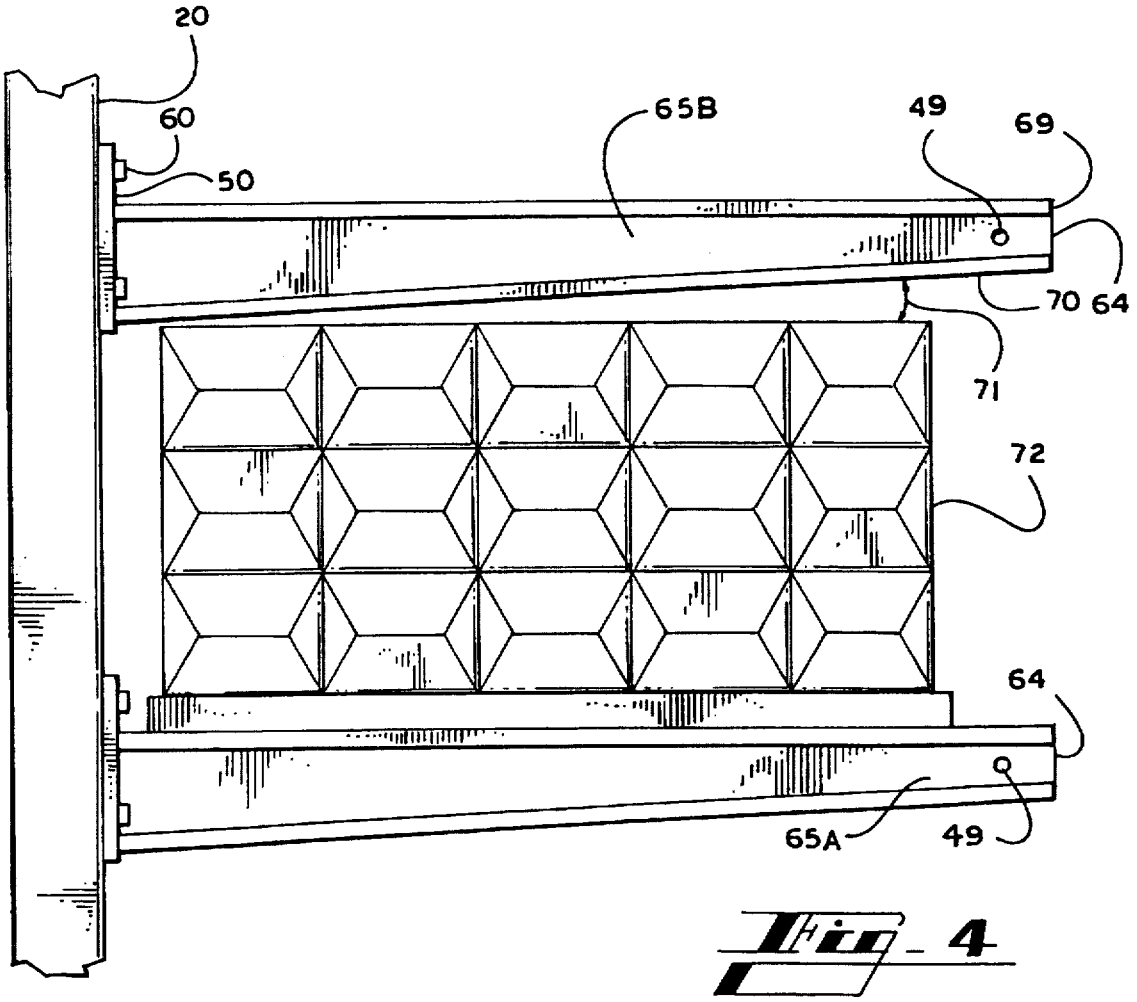
Fig. 4
Fig. 5
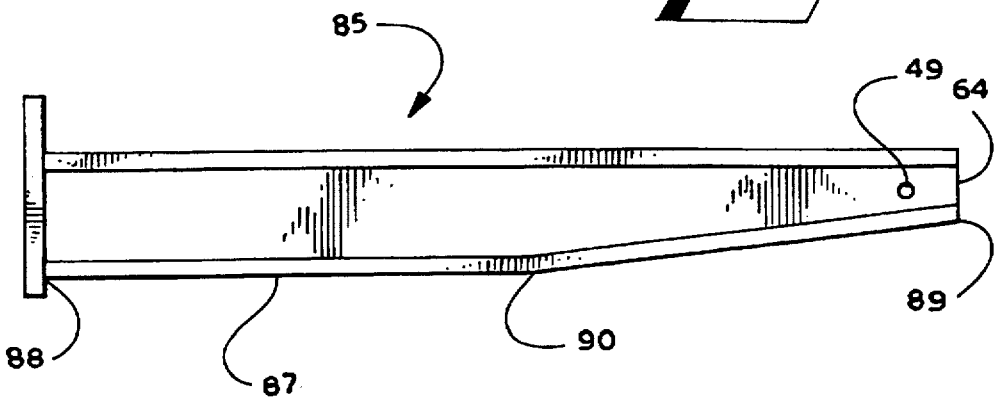

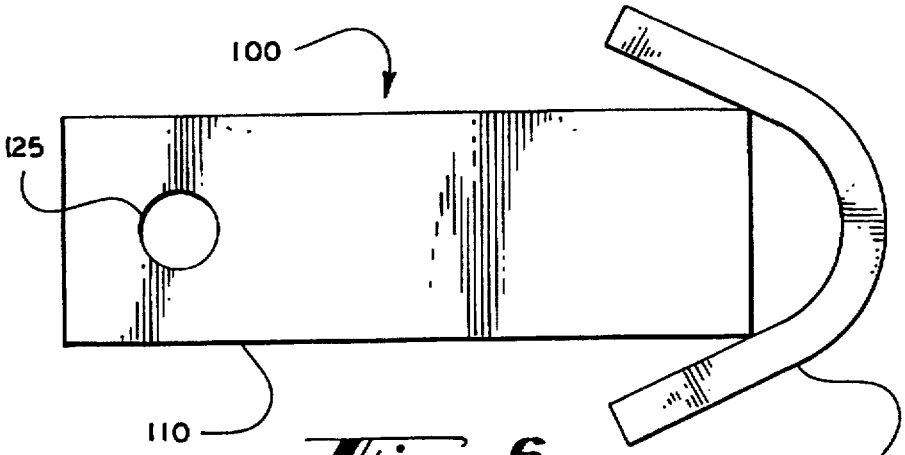
Fig_6
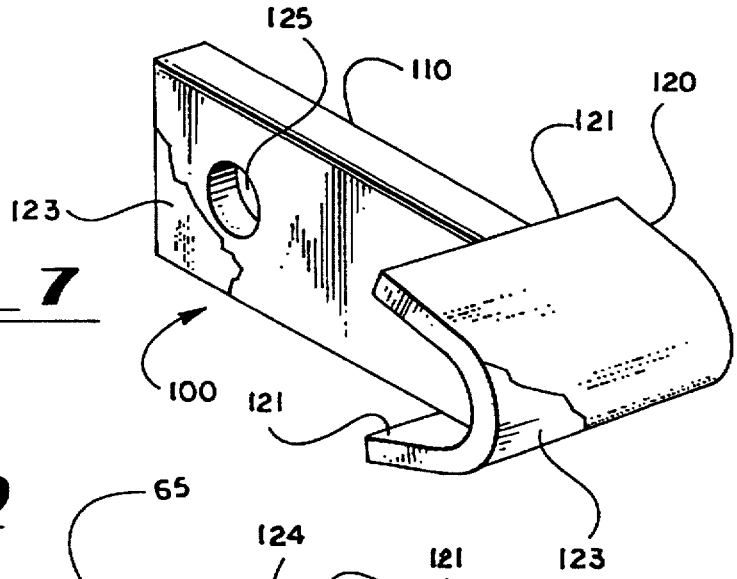
Fig_7
Fig_10
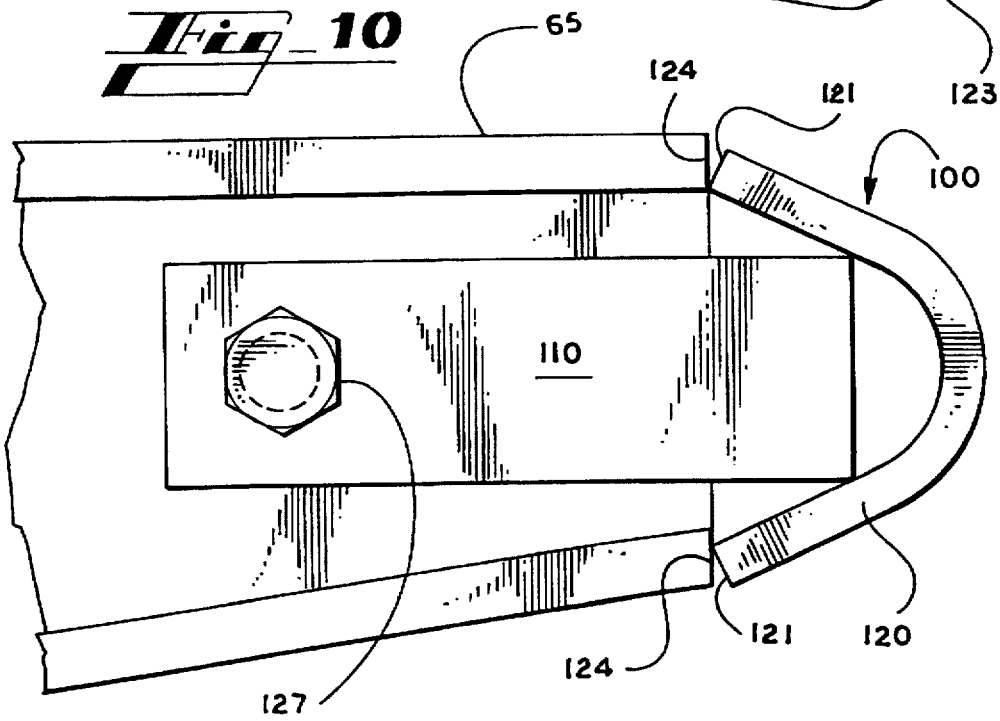

STORAGE RACK SYSTEM WITH TAPERED STORAGE RACK ARM AND STORAGE RACK ARM PROTECTIVE DEVICE

FIELD OF THE INVENTION

This invention relates to material storage systems, and more particularly, relates to a tapered storage rack arm and a storage rack arm protective device.

BACKGROUND OF THE INVENTION

In modern warehouses and the now familiar warehouse style shopping centers, such as do-it-yourself home improvement stores, a variety of open rack material storage systems are used to store such items as lumber, steel, and a variety of palletized goods. In a typical setting, a warehouse may have a network of open rack storage units which often includes rows of storage rack arms which extend outwardly from upright support structures in a cantilever configuration. Typically a number of rows are provided which allow material to be stored vertically to maximize use of warehouse space. Such storage rack units are typically disposed in spaced apart relation to provide aisles there between through which personnel may travel with material handling devices, such as forklifts, and through which customers may travel for viewing and selecting goods.

An operator typically will load material across two or more adjacent storage rack arms by hand or by using a variety of material handling storage devices, such as a forklift. In order to maximize the capacity of a given row of storage rack arms, the operator typically attempts to load a sufficient amount of material onto a row of storage rack arms to fill the space between that row of storage rack arms and the next row of storage rack arms immediately above the row of storage rack arms being loaded.

Loading material onto such storage rack arms requires skill by the operator to avoid striking the outer edges of the outwardly extending storage rack arms disposed in the row of storage rack arm:; immediately above the row of storage rack arms onto which material is being loaded. Likewise, care must be taken to avoid striking storage rack arms when unloading material. Striking the storage rack arms may not only damage the storage rack arms themselves, but may damage the material being loaded or the material handling device, or may cause personal injury to the operator.

Care also must be exercised to avoid personal injury caused by collision by personnel and customers with the outer edges of the outwardly-extending storage rack arms during loading and unloading operations and during shopping activities by customers. Moreover, with the advent of warehouse shopping centers, the exposed outer edges of the storage rack arms diminish the aesthetic appearance of the goods being displayed thereon.

It is known in the art to provide a protector assembly for mounting beneath the outwardly extending storage rack arms and which extends forwardly of the outer edges of the storage rack arms for preventing injury to personnel and equipment resulting from striking the ends of the outwardly extending storage rack arms. However, such systems reduce storage capacity, significantly increase the weight and cost of the storage rack unit and are unsightly to customers. Also, such systems do not reduce the level of precision required by operators in placing a load of material immediately beneath such protector assemblies.

SUMMARY OF INVENTION

Stated in general terms, the present invention provides a cantilever style storage rack system with unique outwardly extending tapered storage rack arms. A storage rack arm protective device is provided for covering the exposed outer ends of the storage rack arms. The present invention allows for safe and efficient loading and unloading of a storage rack unit and reduces the probability of injury or damage caused by accidental collision with outwardly extending storage rack aims by personnel, customers and equipment.

Stated in somewhat greater detail, a device for protecting an exposed end of a storage rack arm is provided comprising an elongate support member having first and second ends and an arcuately shaped member attached to the first end of the elongate support member. A suitable fastener affixes the device to the exposed end of the storage rack arm. Preferably, the elongate support member includes an aperture adjacent to the second end of the elongate support member, the aperture corresponding to an aperture disposed adjacent the exposed end of the storage rack arm. The device may be coated with a resilient material, such as an elastomeric coating or the like, to prevent injury from sharp comers of edges. Alternatively, only the arcuately shaped member may be coated.

In another aspect of the present invention, a tapered storage rack arm is provided comprising an elongate member having first and second ends where the elongate member has upper and lower sides. The height of the elongate member is defined as the distance between the upper and lower sides. The lower side is tapered from a taper point to the second end, such that the height of the elongate member is less at the second end than at the taper point.

The taper point is a point along the length of the tapered storage rack arm at which the lower side begins to taper toward the second end. If desired, taper point is the first end of the elongate member. Alternatively, the taper point may be located medially of the elongate member. The upper side of the tapered storage rack arm may be inclined from the first end to the second end. The angle of incline is preferably between about three and four degrees off horizontal. If desired, the storage rack arm protective device, discussed above, may be attached to the exposed outer end of the tapered storage rack arm.

Accordingly, it is an object of the present invention to provide an improved storage rack system.

It is another object of the present invention to provide a tapered storage rack arm which allows for safe and efficient loading and unloading of material.

It is a further object of the present invention to provide a protective device for attachment to the exposed outer end of a storage rack arm for protecting personnel, customers, equipment and material from accidental collision with the exposed outer side of a storage rack arm.

Other objects and advantages of the present invention will become more readily apparent from the following description of the preferred embodiment.

BRIEF DESCRIPTION OF THE DRAWINGS

FIG. 4 is a side elevation view showing two tapered storage rack arms, as in FIG. 2, mounted on a support column as part of a storage rack unit of FIG. 1.

FIG. 5 is a side elevation view of an alternate embodiment of a tapered storage rack arm according to the present invention.

FIG. 6 is a side elevation view of a storage rack arm protective device according to a preferred embodiment of the present invention.

FIG. 7 is a top pictorial view of the storage rack arm protective device shown in FIG. 6.

FIG. 10 is a side elevation view of a storage rack arm protective device of the present invention attached to the tapered storage rack arm of FIG. 2.

DESCRIPTION OF DISCLOSED EMBODIMENT

Figure 1:
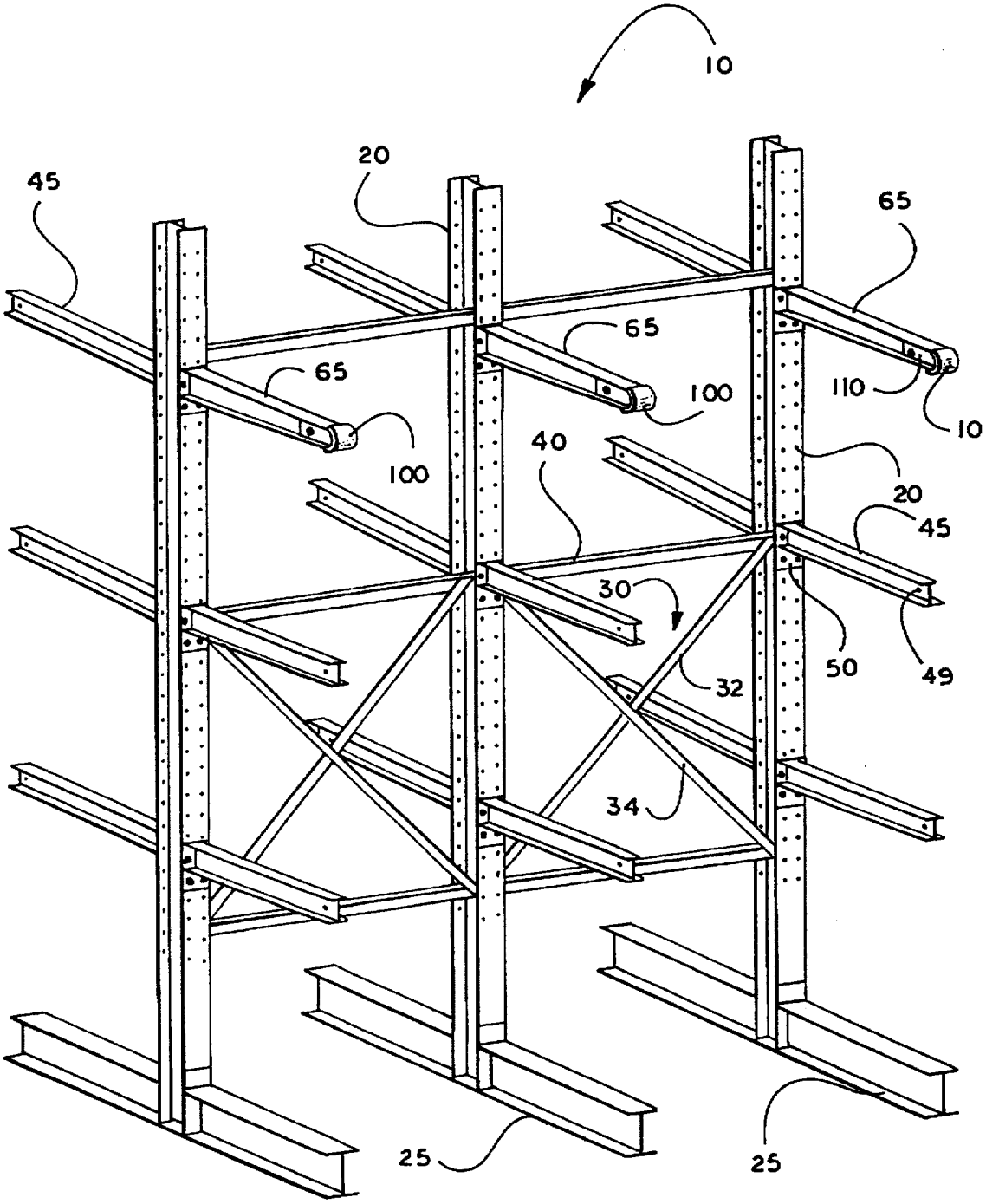
FIG. 1 is a pictorial view of a typical cantilever storage rack unit utilizing storage rack arms and storage rack arm protective devices according to the preferred embodiment of the present invention.

Referring now in more detail to the drawings, in which like numerals refer to like parts throughout the several views, FIG. 1 shows a storage rack unit 10 embodying the present invention. As will be discussed in detail below, the storage rack unit 10 includes a plurality of storage rack arms, including tapered storage rack arms 65 of the present invention. As shown in FIG. 1, storage rack arm protective devices 100 are fastened to the outer ends of the tapered storage rack arms 65. The assemblies and sub-assemblies thus far noted will now be described in detail.

The storage rack unit 10 includes a plurality of support columns 20, extending upwardly from a plurality of base members 25, a brace panel 30 comprised of cross members 32 and 34 disposed between adjacent support columns, and horizontal brace members 40 also disposed between adjacent support columns. A plurality of storage rack arms 45 are fastened to the support columns 20 to extend outwardly in a cantilever configuration in order to form supports on which material may be loaded and displayed. A hole 49 is formed through the thickness of the arms 45 adjacent the outer end of each arm. As is well known to those skilled in the art, the holes 49 may be used to attach securing devices such as ropes and cords, or may be used to attach auxiliary devices such as the storage rack protective device of the present invention which is discussed below. A back plate 50 is welded to the inner end of each storage rack arm 45 for attaching the storage rack arms 45 to the support columns 20 of the storage rack unit 10. The storage rack arms 45 may be bolted to support columns 20, as illustrated in FIG. 1, or may be attached by other known means, such as welding.

Figure 2:
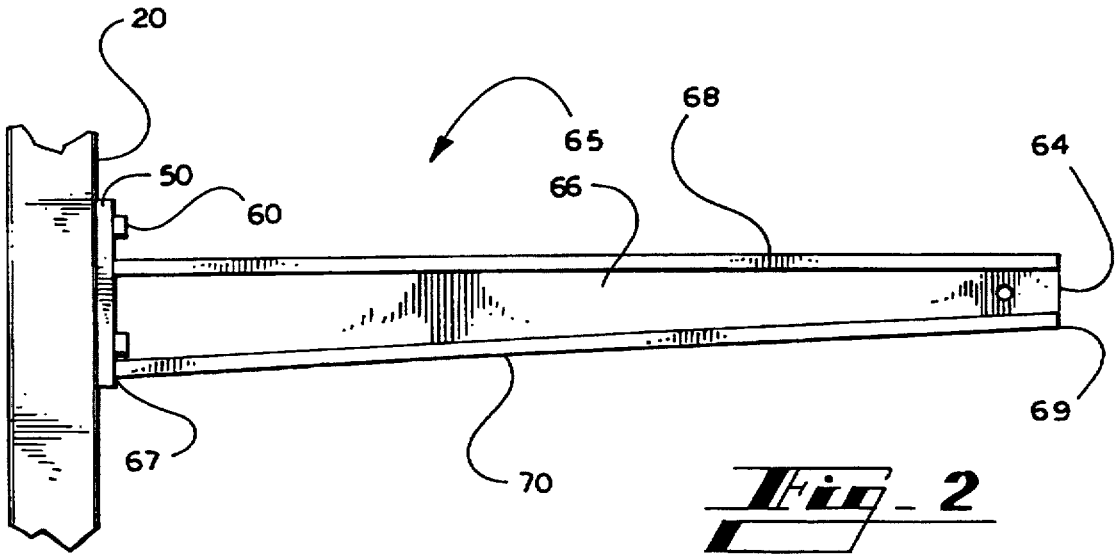
FIG. 2 is a side elevation view of a tapered storage rack arm shown in FIG. 1.
Figure 3:
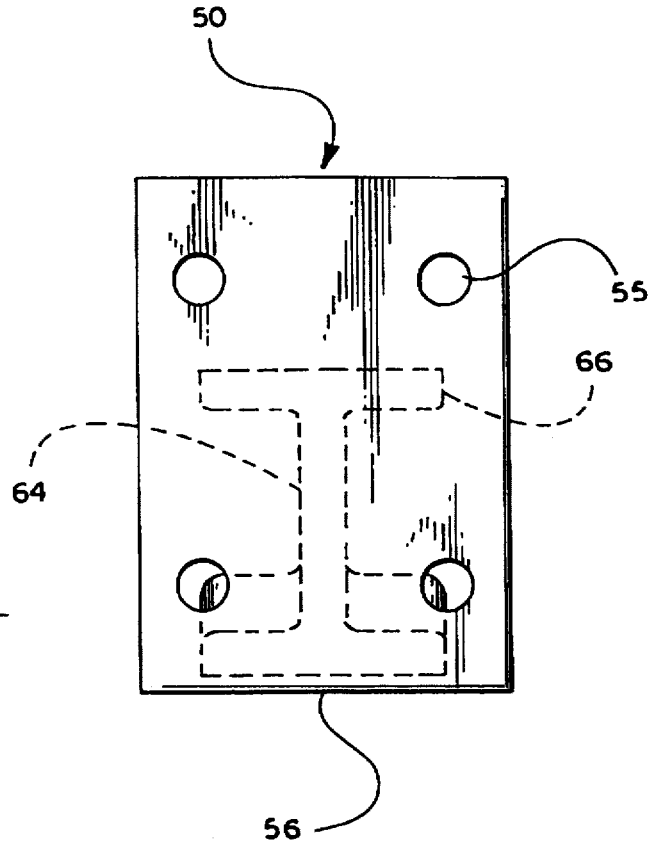
FIG. 3 is a rear elevation view of a back plate attached to the rear end of the tapered storage rack arm of FIG. 2.

Details of the tapered storage rack arm 65 of the present invention are shown in FIGS. 2–4. As shown in FIG. 2, the tapered storage rack arm 65 includes a tapered structural member 66 welded to a back plate 50. Preferably, the tapered storage rack arm 65 is constructed from a tempered steel I-beam having a web 64 extending between plates comprising the upper side 68 and the lower side 70 of the tapered storage rack arm. The size of the tapered storage rack arms 65 is determined in part by the weight and shape of the articles to be supported on the arms and by the layout of the warehouse or other space containing one or more storage rack units 10. In a particular implementation, the tapered storage rack arm 65 has a length on the order of 52.5 inches (133.35 cm). The tapered storage rack arm 65 is attached to one of the support columns 20 of the storage rack unit 10 by bolting the back plate 50 to the support column using bolts 60, as shown in FIG. 2.

FIG. 3 is a rear plan view of the back plate 50 and shows holes 55 through which the bolts 60 are inserted. A cross-sectional view of the tapered structural member 66 is shown in phantom in FIG. 3. This configuration shows the inner end 67 of the structural member 66 attached to the lower end 56 of the back plate 50. It should be understood that the structural member 66 may be attached at other locations along the back plate 50, as desired by the end user.

Referring still to FIG. 2, in the preferred embodiment of the present invention the upper side 68 of the tapered storage rack arm 65 is slightly inclined from the inner end 67 attached to the support column 20 to the outer end 69. In the preferred embodiment of the present invention, the incline angle is on the order of three to four degrees (3°–4°) from the inner end 67 to the outer end 69 of the structural member 66. It should be understood that the inclined upper side 68 of the tapered storage rack arm 65 assists in urging loads toward the support column 20. The urging of loads toward the support column 20 assists in channeling loading forces through to the support columns and counteracts shifting of material loaded on the tapered storage rack arm 65 toward the outer end 69 of the tapered storage rack arm. The inclined configuration also counteracts torsional forces generated about the connection of the back plate 50 to the support column 20.

As shown in FIG. 2, the lower side 70 of the tapered-storage rack arm 65 is tapered, relative to the upper side 68, from the inner end 67 to the outer end 69 of the structural member 66. Preferably the taper is on the order of fifty percent (50%) over the length of the structural member 66. For example, in the preferred embodiment, where the height of the structural member 66 is defined as the vertical distance between the upper side 68 and the lower side 70 of the structural member 66, the tapered storage rack arm has a height of approximately four inches (10.16 cm) at the inner end 67 of the structural member and a height at the outer end 69 of the structural member of approximately two inches (5.08 cm).

The tapered storage rack arm 65 provides strong structural support for material loaded thereon. The tapered configuration of the lower side 70 allows personnel to load and unload material more efficiently from the next lower storage rack arm without interference with the lower side of the superjacent storage rack arm, and assists personnel in avoiding collision of a load of material with the outer end 69 of the tapered storage rack arm 65. For example, FIG. 4 shows a lower tapered storage rack arms 65A and a superjacent storage rack arm 65B mounted to a support column 20. When a load of palletized material 72 is placed on a row of storage rack arms, illustrated as tapered storage rack arm 65A, the tapered lower side 70 of the storage rack arm 65B provides clearance 71 for the warehouse personnel to load and unload the material without striking the outer end 69 or the lower side 70 of the tapered storage rack arm 65B.

Additionally, the outer end 69 of the tapered storage rack arm 65 has a smaller cross-sectional profile than conventional non-tapered storage rack arms, such as the storage rack arm 45, shown in FIG. 1. Accordingly, customers in warehouse ;shopping centers see less of the storage rack arm and more of the products or goods displayed thereon.

As shown in FIG. 5, an alternate tapered storage rack arm 85 is provided where the lower side 87 is tapered from a taper point 90 located approximately medially of the length of the alternate tapered storage rack arm. In the alternate form shown in FIG. 5, the height of the tapered storage rack aim 85 remains constant from the inner end 88 out to the taper point 90 which is approximately half the length of the alternate tapered storage rack arm. At the taper point 90, the lower side 87 of the alternate tapered storage rack arm 85 tapers to the outer end 89. Preferably the height of the arm 85 tapers approximately fifty percent (50%) from the taper point 90 to the outer point 89. For example, in the preferred form of the alternate tapered storage rack arm 85, the height of the arm 85 is approximately four inches (10.16 cm) at the taper point 90 and tapers to a height of approximately two inches (5.08 cm) at the outer end 89.

It should be understood that the alternate storage rack arm 85 is used in the same applications as described for the tapered storage rack arm 65, but provides for stronger structural support when desired by the end user.

Figure 8:
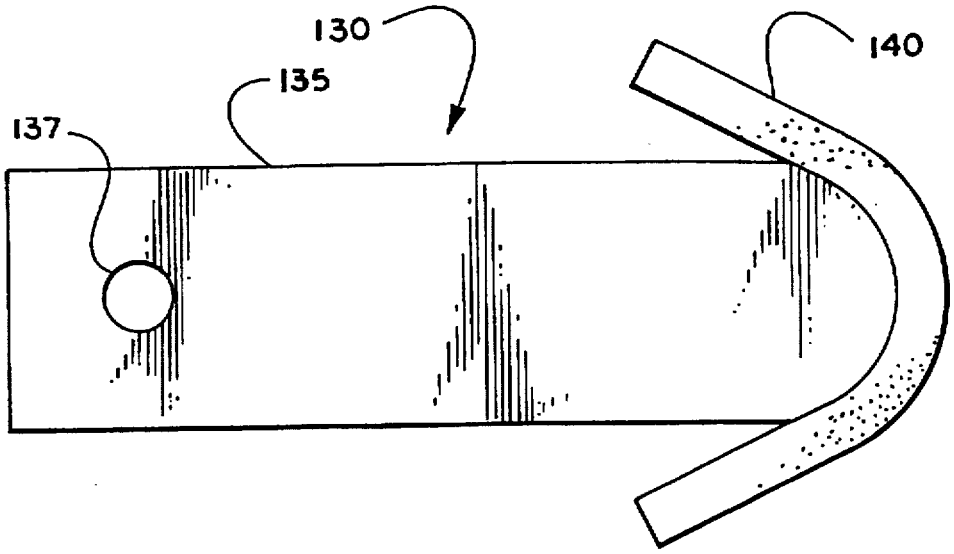
FIG. 8 is a side elevation view of an alternate embodiment of the storage rack arm protective device according to the present invention.
Figure 9:
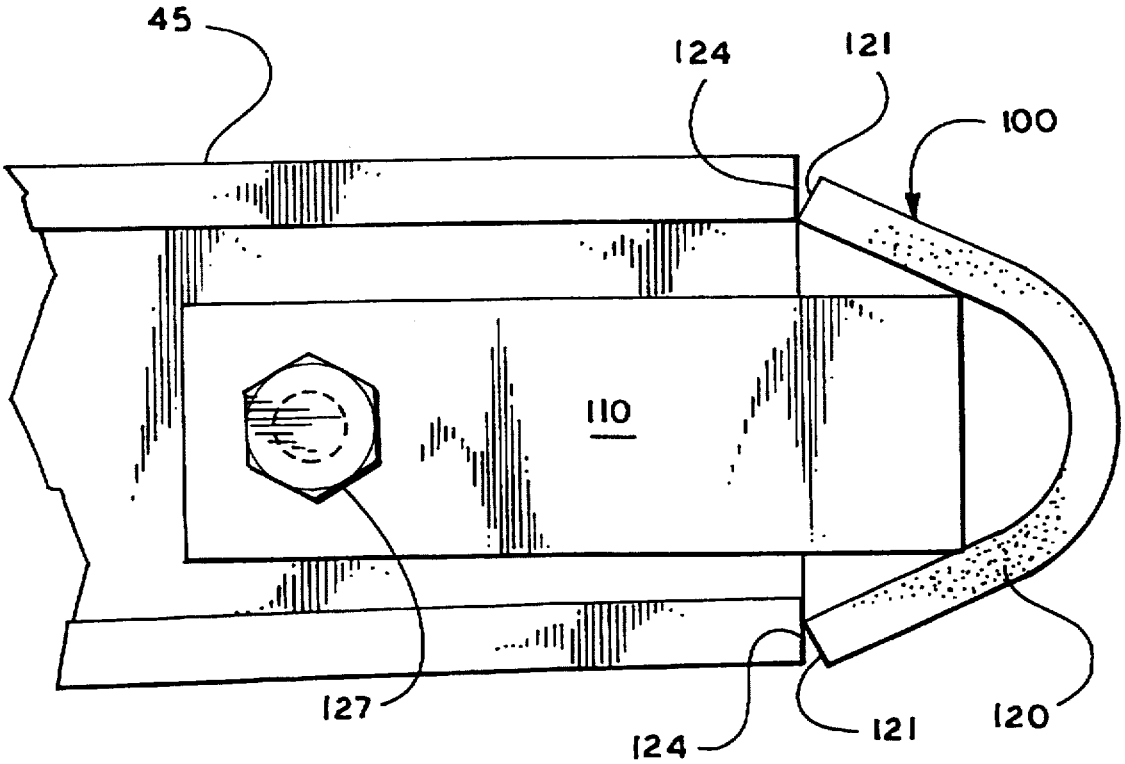
FIG. 9 is a side elevation view of the storage rack arm protective device of the present invention attached to an non-tapered storage rack arm.

Details of the storage rack arm protective device 100 are shown in FIGS. 6–10. As shown in FIGS. 6 and 7, the storage rack arm protective device 100 includes a support plate 110 and an arcuately shaped nose plate 120 attached to the support plate. The support plate 110 is a flat plate configured to fit flush against one side of the web 64 of the rack arm 65, ant the nose plate 120 is approximately hemi-cylindrical along a horizontal axis and perpendicular to the length of the support plate. The nose plate 120 is roughly parabolic in transverse section, as seen in FIG. 6. A hole 125 is provided in the support plate 110 for attachment of the storage rack arm protective device 100 to a storage rack arm 45, as shown in FIG. 9.

Referring to FIGS. 1 and 9, the storage rack arm protective device 100 is bolted to a standard storage rack arm 45 using a bolt 127 extending through the hole 125 and hole 49 through the web 64 near the outer end 69. It should be understood, however, that the protective device 100 may be attached to a storage rack arm 45 by other means, such as welding. In the preferred embodiment, the storage rack arm protective device 100 is attached to the tapered storage rack arm 65 or to the alternate tapered storage rack arm 85, both of which are described in detail above. FIGS. 1 and 10 show the storage rack arm protective device 100 attached to a tapered storage rack arm 65.

The storage rack arm protective device 100 provides a protective covering for the outer end of the storage rack arm 45, as shown in FIG. 1, or preferably for the tapered storage rack arms 65, as shown in FIG. 10. The outer longitudinal sides 121 of the nose plate 120 approximately align with the confronting ends 124 of the plates forming the upper and lower sides 68 and 70 of the rack arms 65, as best seen in FIGS. 7, 9 and 10. Accordingly, the protective device 100 protects personnel, customers, equipment, and material from injury or damage caused by inadvertent collision with the exposed outer end of a storage rack arm. Additionally, if material being loaded onto the storage rack arm is slightly low or high, such that the upper surface of the material or the lower surface of the material, as the case may be, collides with the arcuately shaped nose plate 120, the arcuately shaped nose plate 120 assists in deflecting the material over or under the storage rack arm, as appropriate.

Referring now to FIGS. 6 and 7, in a particular implementation of the present invention, the storage rack arm protective device 100 is constructed from steel. The support plate 110 has a length on the order of 2½ inches (6.35 cm) and a height on the order of 1.0 inches (2.54 cm). The thickness of the support plate 110 is on the order of 3/16 inches (0.476 cm). The arcuately shaped nose plate 120 has a thickness on the order of 3/16 inches (0.476 cm). The turning radius of the arcuately shaped nose plate 120 is approximately ½ inches (1.25 cm).

In the preferred embodiment, the storage rack arm protective device 100 is coated with a resilient elastomeric material coating 123, for example polyvinyl chloride (PVC). If desired, only the arcuately shaped nose plate 120 may be coated. The protective device 100 is coated using techniques well known to those skilled in the art, such as plastic or vinyl dipping. The elastomeric coating of the protective device 100 provides a soft finish and helps to prevent injury to personnel, customers, products or equipment caused by accidental collision with the protective device 100.

If desired, the elastomeric coating may be colored so as to provide the protective device 100 with a finish which contrasts with the storage rack arm to which it is attached as shown in FIG. 9. For example, the elastomeric coating may be colored yellow in order to caution personnel and customers of its location.

Alternatively, the protective device 100 or the arcuately shaped nose plate 120 may be painted instead of being coated as described above. As with the colored resilient coating, the protective de-vice 100 may be painted with a cautionary color, such as yellow, to alert personnel and customers of the location of the outer end of the storage rack arm 45 and of the protective device 100.

An alternate form of a storage rack arm protective device is shown at FIG. 8. The alternate protective device 130, shown in FIG. 8, is a one-piece molded unit and includes a support member 135, and an arcuately shaped nose member 140. The alternate protective device 130 is preferably formed from an elastomer material, such as polypropylene or polyurethane. The alternate protective device 130 is molded using known plastic molding processes. As with the protective device 100, discussed above, the alternate protective device 130 may be colored to provide contrast with the storage rack arm to which it is attached.

Another alternative form (not shown) of the storage rack arm protective device includes a metal support plate, such as the support plate 110 of the protective device 100, shown in FIG. 6, embedded into a formed elastomeric arcuately-shaped nose member, such as the nose member 140 of the alternate protective device 130 shown in FIG. 8.

It should be understood that the foregoing relates only to a preferred embodiment of the present invention and that numerous changes and modifications thereto may be made without departing from the spirit and scope of the invention as defined in the following claims.

We claim:

1. A device for protecting an exposed end of a storage rack arm, comprising:

an elongate support member having first and second ends and having upper and lower sides;

an arcuately shaped member having an inner surface and an outer surface, said inner surface being attached to a first end of each of said upper and lower sides of said elongate support member; and means for affixing said second end of said elongate support member to said exposed end of said storage rack arm.

2. The device of claim 1, wherein:

said elongate support member comprises an aperture adjacent said second end of said elongate support member, said aperture corresponding to an aperture formed adjacent said exposed end of said storage rack arm.

3. The device of claim 1, wherein at least the arcuately-shaped member is coated with an elastomer.

4. An improved storage rack arm, comprising:

an elongate arm member having first and second ends, said elongate arm member further having upper and lower sides, wherein the height of said elongate arm member is defined as the distance between said upper and lower sides, and said lower side being tapered from a taper point to said second end such that said height of said elongate arm member is less at said second end than at said taper point;

a device for covering said second end of said elongate arm member, said device having an elongate support member having first and second ends, said device having a generally arcuately shaped member, said generally arcuately shaped member being attached to said first end of said elongate support member, and said device being attached to said second end of said elongate arm member.

5. The improved storage rack arm of claim 4, wherein said taper point is said first end of said elongate arm member.

6. The improved storage rack arm of claim 4, wherein said taper point is located medially of said elongate arm member.

7. The improved storage rack arm of claim 4, wherein said upper side is inclined from said first end to said second end.

8. The improved storage rack arm of claim 4, wherein said upper side is inclined at an angle of between about three and four degrees off horizontal.

9. The improved storage rack arm of claim 4, wherein said device is coated with a protective coating.

10. In a storage rack system having a plurality of base members and a plurality of support columns extending vertically from said plurality of base members, said storage rack system comprising:

a plurality of storage rack arms extending outwardly from said plurality of support columns, each of said storage rack arms including, an elongate member having first and second ends;

said elongate member further having upper and lower sides, wherein the height of said elongate member is defined as the distance between said upper and lower sides, said lower side being tapered upwardly from a taper point to said second end such that said height of said elongate member is less at said second end than at said taper point; and a device for covering said second end of said elongate member, said device having an elongate support member having first and second ends, said device having a generally arcuately shaped member, said generally arcuately shaped member being attached to said first end of said elongate support member, and said device being attached to said second end of said elongate arm member.

11. The storage rack system of claim 10, wherein said taper point is said first end of said elongate member.

12. The storage rack system of claim 10, wherein said taper point is located medially of said elongate member.

13. The storage rack system of claim 10, wherein said upper side is inclined upwardly from said first end to said second end.

14. The storage rack system of claim 13, wherein said upper side is inclined at an angle of between about three and four degrees off horizontal.

15. An improved storage rack arm, comprising:

an elongate arm member having first and second ends, said elongate arm member further having upper and lower sides, wherein said lower side is substantially parallel to said upper side; and a device for covering said second end of said elongate arm member, said device having an elongate support member having first and second ends, said device having a generally arcuately shaped member, said generally arcuately shaped member being attached to said first end of said elongate support member, and said device being attached to said second end of said elongate arm member.

16. The improved storage rack arm of claim 15, wherein said upper side is inclined from said first end to said second end.

17. The improved storage rack arm of claim 15, wherein said upper side is inclined at an angle of between about three and four degrees off horizontal.

18. The improved storage rack arm of claim 15, wherein said device is coated with a protective coating.

* * * * *